US006364822B1

(12) United States Patent
Herman et al.

(10) Patent No.: US 6,364,822 B1
(45) Date of Patent: Apr. 2, 2002

(54) HERO-TURBINE CENTRIFUGE WITH DRAINAGE ENHANCING BAFFLE DEVICES

(75) Inventors: Peter K. Herman; Kevin South, both of Cookeville, TN (US)

(73) Assignee: Fleetguard, Inc., Nashville, TN (US)

( * ) Notice: Subject to any disclaimer, the term of this patent is extended or adjusted under 35 U.S.C. 154(b) by 0 days.

(21) Appl. No.: 09/732,276

(22) Filed: Dec. 7, 2000

(51) Int. Cl.[7] ..... B04B 1/08; B04B 9/06
(52) U.S. Cl. ..... 494/49; 494/60; 494/70
(58) Field of Search ..... 494/24, 36, 43, 494/49, 60, 64, 65, 67, 68, 70, 84, 901; 210/168, 171, 232, 360.1, 380.1, 416.5; 184/6.24

(56) References Cited

U.S. PATENT DOCUMENTS

| | | | |
|---|---|---|---|
| 882,119 | A | 3/1908 | Ohlsson |
| 955,890 | A | 4/1910 | Marshall |
| 993,791 | A | 5/1911 | Ohlsson |
| 1,006,662 | A | 10/1911 | Bailey |
| 1,038,607 | A | 9/1912 | Lawson |
| 1,136,654 | A | 4/1915 | Callane |
| 1,151,686 | A | 8/1915 | Hult et al. |
| 1,232,811 | A | 7/1917 | Kimball |
| 1,293,114 | A | 2/1919 | Kendrick |
| 1,422,852 | A | 7/1922 | Hall |
| 1,482,418 | A | 4/1924 | Unger |
| 1,525,016 | A | 2/1925 | Weir |
| 1,784,510 | A | 12/1930 | Berline |
| 2,031,734 | A | 2/1936 | Riebel, Jr. et al. |
| 2,053,856 | A | 9/1936 | Weidenbacker |
| 2,087,778 | A | 7/1937 | Nelin |
| 2,129,751 | A | 9/1938 | Wells et al. |
| 2,302,381 | A | 11/1942 | Scott |
| 2,305,469 | A | 12/1942 | Forsberg |

(List continued on next page.)

FOREIGN PATENT DOCUMENTS

| | | | |
|---|---|---|---|
| CA | 1079699 | | 6/1980 |
| DE | 1097370 | * | 1/1961 |
| FR | 1275728 | | 10/1991 |
| GB | 229647 | | 2/1926 |
| GB | 812047 | | 4/1959 |
| GB | 1089355 | | 11/1967 |
| GB | 1507742 | | 4/1978 |
| GB | 2049494 | | 12/1980 |
| GB | 2311022 | A | 9/1997 |
| IT | 444256 | | 1/1949 |

(List continued on next page.)

OTHER PUBLICATIONS

SAE Paper No. 971631, "Soot and Wear in Heavy Duty Diesel Engines", Robert Mainwaring, International Spring Fuels & Lubricants Meeting, Dearborn, Michigan, May 5–8, 1997.

Theodore De Loggio and Alan Letki, "New Directions in Centrifuging", *Chemical Engineering*, pp. 70–76, Jan., 1994.

Spinner II® product brochure, T.G. Hudgins, Incorporated, 1985.

"Theory of Separation", Alfa Laval Separation AB, pp. 1–8.

*Primary Examiner*—Charles E. Cooley
(74) *Attorney, Agent, or Firm*—Woodard, Emhardt, Naughton, Moriarty & McNett

(57) ABSTRACT

A cone-stack centrifuge for separating particulate material out of a circulating fluid includes a rotor assembly configured with a hollow rotor hub and is constructed to rotate about an axis by the ejection of the fluid from nozzles in the rotor assembly. The rotor assembly is mounted on a shaft that is attached to the hub of a base. The base further includes a fluid inlet, a passageway connected to the inlet and in fluid communication with the rotor assembly, and fluid outlet. A bearing arrangement is positioned between the rotor hub and the shaft for rotary motion of the rotor assembly about the shaft. The base further includes a baffle for re-directing a swirling flow of fluid out of the base in a radial direction and into the fluid outlet.

13 Claims, 3 Drawing Sheets

U.S. PATENT DOCUMENTS 2,321,144 A * 6/1943 Jones
2,335,420 A * 11/1943 Jones
2,485,390 A 10/1949 Langmuir
2,578,485 A 12/1951 Nyrop
2,665,060 A 1/1954 Harstick
2,725,190 A 11/1955 Hein et al.
2,735,614 A 2/1956 Hubmann
2,738,923 A 3/1956 Harstick
2,752,090 A 6/1956 Kyselka et al.
2,755,017 A 7/1956 Kyselka et al.
2,973,896 A 3/1961 Peltzer, Sr.
3,036,759 A 5/1962 Bergner
3,080,109 A 3/1963 Halbach
3,187,998 A 6/1965 Madany
3,273,324 A 9/1966 Jennings
3,430,853 A 3/1969 Kirk et al.
3,432,091 A 3/1969 Beazley
3,784,092 A 1/1974 Gibson
3,858,793 A 1/1975 Dudrey
3,879,294 A 4/1975 Ellis et al.
3,990,631 A 11/1976 Schall
4,067,494 A 1/1978 Willus et al.
4,106,689 A 8/1978 Kozulla
4,165,032 A 8/1979 Klingenberg
4,221,323 A 9/1980 Courtot
4,230,581 A 10/1980 Beazley
4,262,841 A 4/1981 Berber et al.
4,284,504 A * 8/1981 Alexander et al. ..... 210/168
4,288,030 A 9/1981 Beazley et al.
4,325,825 A 4/1982 Schutte
4,346,009 A 8/1982 Alexander et al.
4,400,167 A 8/1983 Beazley et al.
4,427,407 A 1/1984 Paschedag
4,431,540 A 2/1984 Budzich
4,460,352 A 7/1984 Bruning
4,492,631 A * 1/1985 Martin ..... 494/901
4,508,530 A 4/1985 Schlegel et al.
4,498,898 A 5/1985 Haggett
4,557,831 A * 12/1985 Lindsay et al. ..... 210/232
4,615,315 A 10/1986 Graham
4,698,053 A 10/1987 Stroucken
4,731,545 A 3/1988 Lerner et al.
4,787,975 A 11/1988 Purvey
4,861,329 A 8/1989 Borgström et al.
4,915,682 A 4/1990 Stroucken
4,950,130 A 8/1990 Erlach
4,961,724 A 10/1990 Pace
5,045,049 A 9/1991 Lantz
5,052,996 A 10/1991 Lantz
5,096,581 A 3/1992 Purvey
5,169,065 A 12/1992 Bloch
5,213,260 A 5/1993 Tonkinson
5,342,279 A 8/1994 Cooperstein
5,354,255 A 10/1994 Shapiro
5,362,292 A 11/1994 Borgström et al.
5,374,234 A 12/1994 Madsen
5,575,912 A * 11/1996 Herman et al. ..... 494/70
5,637,217 A * 6/1997 Herman et al. ..... 494/70
5,674,392 A 10/1997 Christophe et al.
5,707,519 A 1/1998 Miller et al.
5,779,618 A 7/1998 Onodera et al.
5,795,477 A 8/1998 Herman et al.
6,017,300 A * 1/2000 Herman ..... 494/49
6,019,717 A * 2/2000 Herman ..... 494/70
6,183,407 B1 * 2/2001 Hallgren et al. ..... 494/49
6,196,962 B1 3/2001 Purvey et al.

FOREIGN PATENT DOCUMENTS

SU 145089 * 1/1962 ..... 494/49
SU 362643 12/1972
SU 564884 7/1977
SU 578110 * 10/1977 ..... 494/49
SU 633609 11/1978
SU 869822 10/1981
SU 1158242 * 5/1985
WO 97/31180 * 8/1997
WO WO 98/11994 3/1998
WO WO 00/44502 8/2000

* cited by examiner

HERO-TURBINE CENTRIFUGE WITH DRAINAGE ENHANCING BAFFLE DEVICES

BACKGROUND OF THE INVENTION

The present invention relates generally to the continuous separation of solid particles, such as soot, from a fluid, such as oil, by the use of a centrifugal field. More particularly the present invention relates to the use of a cone (disk) stack centrifuge configuration within a centrifuge assembly with a base that redirects the residual velocity of fluid discharge from the rotor jet nozzles to assist drainage rate and reduce pooling of oil in the centrifuge base.

Diesel engines are designed with relatively sophisticated air and fuel filters (cleaners) in an effort to keep dirt and debris out of the engine. Even with these air and fuel cleaners, dirt and debris, including engine-generated wear debris, will find a way into the lubricating oil of the engine. The result is wear on critical engine components and if this condition is left unsolved or not remedied, engine failure. For this reason, many engines are designed with full flow oil filters that continually clean the oil as it circulates between the lubricant sump and engine parts.

There are a number of design constraints and considerations for such full flow filters, and typically these constraints mean that such filters can only remove those dirt particles that are in the range of 10 microns or larger. While removal of particles of this size may prevent a catastrophic failure, harmful wear will still be caused by smaller particles of dirt that get into and remain in the oil. In order to try and address the concern over small particles, designers have gone to bypass filtering systems which filter a predetermined percentage of the total oil flow. The combination of a full flow filter in conjunction with a bypass filter reduces engine wear to an acceptable level, but not to the desired level. Since bypass filters may be able to trap particles less then approximately 10 microns, the combination of a full flow filter and bypass filter offers a substantial improvement over the use of only a full flow filter.

While centrifuge cleaners can be configured in a variety of ways as represented by the earlier designs of others, one product which is representative of part of the early design evolution is the Spinner II® oil cleaning centrifuge made by Glacier Metal Company Ltd., of Somerset, Ilminister, United Kingdom, and offered by T.F. Hudgins, Incorporated, of Houston, Tex. Various advances and improvements to the Spinner II® product are represented by U.S. Pat. Nos. 5,575,912; 5,637,217; 6,017,300; and 6,019,717 issued to Herman Nov. 19, 1996; Jun. 10, 1997; Jan. 25, 2000; and Feb. 1, 2000, respectively. These four patents are expressly incorporated by reference herein for their entire disclosures.

Hero-turbine centrifuges, as commonly used as bypass separators on diesel engine lube systems, operate by ejecting a high velocity fluid jet from a nozzle, which drives the centrifuge rotor via reaction force. After ejection from the centrifuge rotor, the fluid must be quickly evacuated from the centrifuge base and drained back to the sump. If the fluid begins to pool in the base, a condition known as flooding can occur, whereby the fluid contacts the turbine ends of the centrifuge rotor and dramatically slows down the speed of rotation. In this flooded condition, the centrifuge is rendered useless since it is no longer spinning at the desired speed and separating particulate from the oil. This condition is usually avoided by designing a very large outlet drain and providing enough head space beneath the rotor to allow some pooling to occur without the oil contacting the rotor.

The need therefore exists for a design that reduces the necessary size of outlet drain or reduces the required head space beneath the rotor, thereby allowing more room for rotor sludge capacity. The present invention meets this need in a novel and non-obvious way.

SUMMARY OF THE INVENTION

One aspect of the invention described herein is providing a centrifuge base with means for redirecting the residual velocity of fluid discharge from the rotor jet nozzles from a tangential direction to a radial direction in order to assist drainage rate and reduce pooling of oil in the centrifuge base.

One form of the present invention contemplates a centrifuge base with a radially directed gravity drain outlet configured with an outlet baffle oriented to redirect the residual fluid velocity in the radially outward direction of the drain outlet.

Another form of the present invention contemplates a centrifuge housing base having a central bottom drain where the base is equipped with spiral vanes to redirect the residual fluid velocity radially inward toward the drain outlet.

One object of the present invention is to provide a unique centrifuge base that assists the oil drainage rate and reduces pooling of oil in the base.

Further objects, features, and advantages of the present invention will be apparent from the description and drawings contained herein.

DESCRIPTION OF THE PREFERRED EMBODIMENTS

Figure 1:
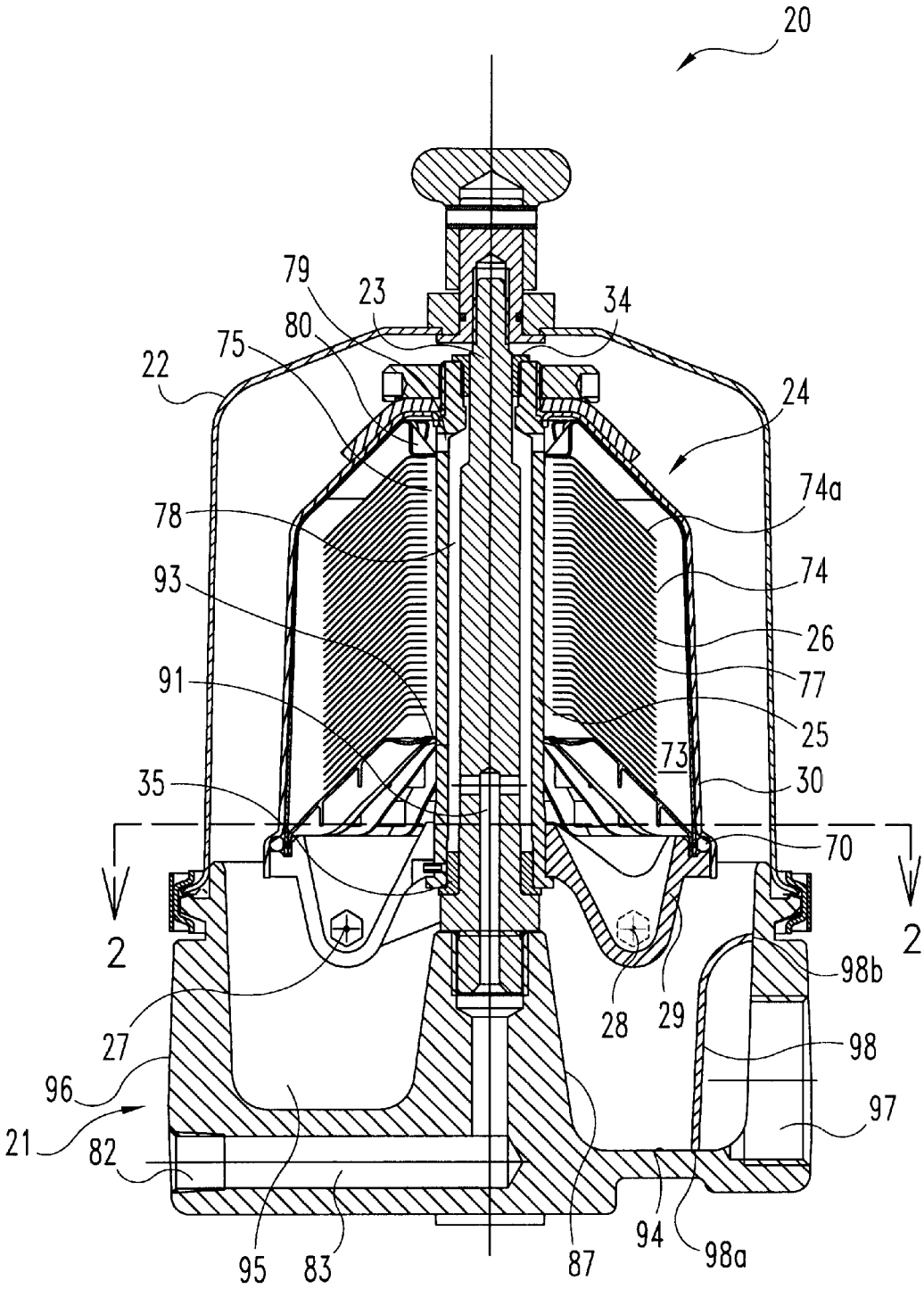
FIG. 1 is a front elevational view in full section of a cone-stack centrifuge according to one embodiment of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1, there is illustrated a cone-stack centrifuge 20 according to a preferred embodiment of the present invention. Centrifuge 20 includes as some of its primary components base 21, bell housing 22, shaft 23, and rotor assembly 24 including rotor hub 25, cone-stack 26, tangential flow jet nozzles 27 and 28, bottom plate 29, and centrifuge bowl 30 securely sealed to bottom plate 29. Axially extending through the center of bottom plate 29 and through the interior of centrifuge bowl 30 is hollow rotor hub 25. Rotor hub 25 is bearingly mounted to and supported by shaft 23 by means of upper and lower bearings 34 and 35, respectively.

Figure 2:
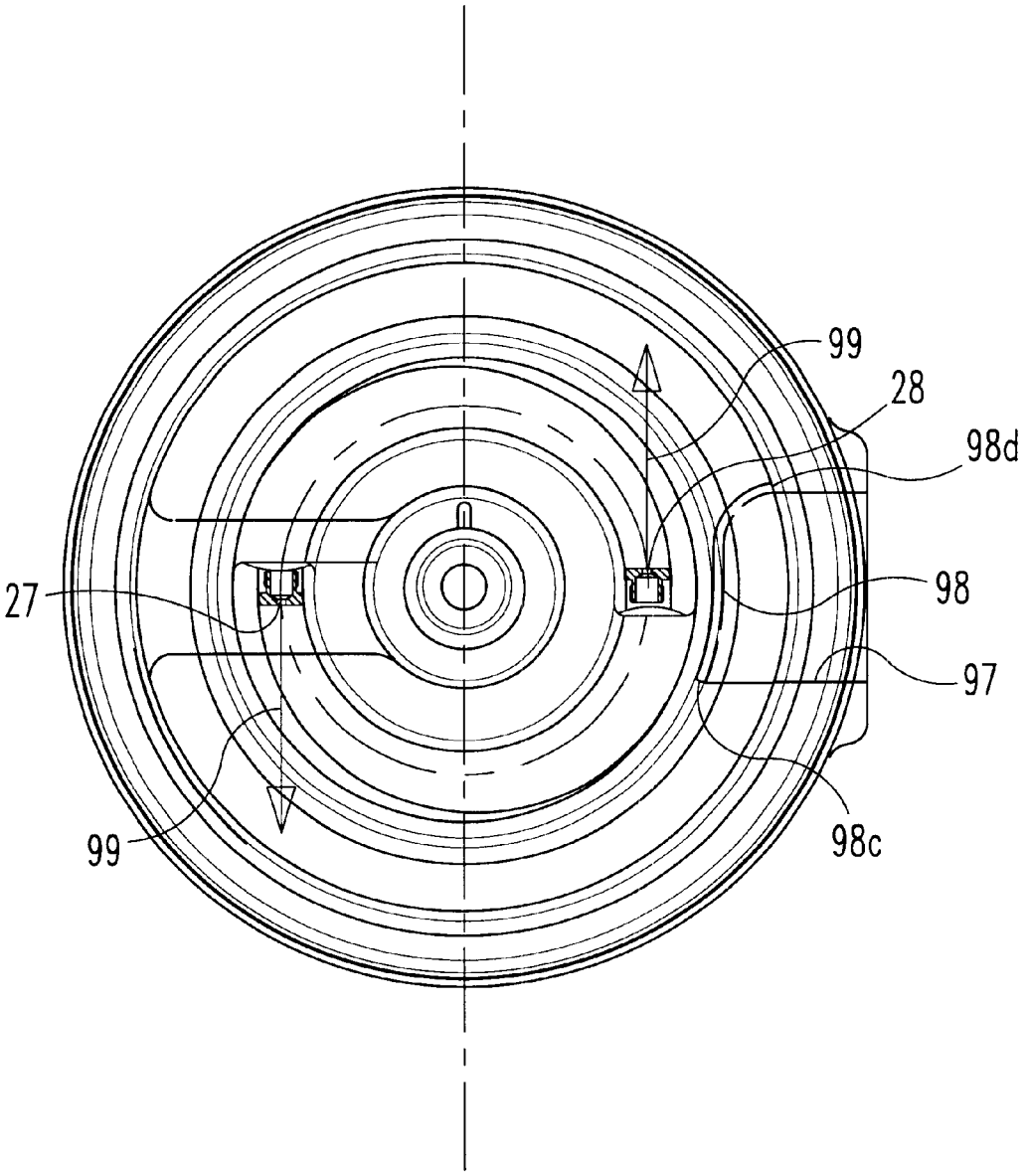
FIG. 2 is a top plan view in full section of the FIG. 1 centrifuge as view along line 2—2 in FIG. 1.

At the lower region of bottom plate 29 are two tangential flow nozzles 27 and 28. These tangential flow nozzles are symmetrically positioned on opposite sides of the axis of rotor hub 25, and their corresponding flow jet directions 99, as seen in FIG. 2, are opposite one another. As a result, these flow nozzles are able to create the driving force for rotating rotor assembly 24 about shaft 23 within bell housing 22, as is believed to be well known in the art. Spinning of centrifuge 20 can also be accomplished with a single flow nozzle, or with the use of more than two flow nozzles.

The assembly between centrifuge bowl 30 and bottom plate 29 in combination with O-ring 70 creates a sealed enclosure defining an interior volume 73 which contains cone-stack 26. Each cone 74 of cone-stack 26 has a center opening 75 and a plurality of inlet holes disposed around the circumference of the cone adjacent the outer annular edge 77. Typical cones for this application are illustrated and disclosed in U.S. Pat. Nos. 5,575,912 and 5,637,217. The typical flow path for rotor assembly 24 begins with the flow of liquid upwardly through the hollow center 78 of rotor hub 25. The flow through the interior of rotor hub 25 exits out through apertures 79. A flow distribution plate 80 is configured with vanes and used to distribute the existing flow out of hub 25 across the surface of top cone 74*a*. The manner in which the liquid (lubricating oil) flows across and through the individual cones 74 of cone-stack 26 is a flow path and flow phenomenon which is well known in the art. This flow path and the high RPM spinning rate of the cone-stack assembly enables the small particles of soot which are carried by the oil to be centrifugally separated out of the oil and held in the centrifuge.

The focus of the present invention is on the design of base 21 which is configured with and defines fluid inlet 82, passageway 83 connected to the inlet, and a fluid outlet that permits the fluid entering base 21 from flow nozzles 27 and 28 to exit base 21. Base 21 further includes base hub 87 and base sidewall 96 defining interior space 95 of base 21. In one embodiment of the present invention, the fluid outlet is radial outlet drain 97 defined by sidewall 96. Shaft 23 which extends through rotor hub 25 is attached to base hub 87 and includes passageway 91 which is in fluid communication with base passageway 83 at one end and with hollow center 78 of rotor hub 25 at the other end.

In operation of centrifuge 20, pressurized fluid enters base 21 through fluid inlet 82 and flows through passageway 83 of base 21. The fluid continues up through base hub 87 and into passageway 91 of shaft 23. The fluid is then delivered to rotor assembly 24 via throttle passageway 93 in shaft 23. The fluid flows through rotor assembly 24 as described above and then exits rotor assembly 24 through tangential flow nozzles 27 and 28 into interior space 95 of base 21.

Since the discharge velocity of exit flow jets 99 from nozzles 27 and 28 is always higher than the counter-rotational velocity of nozzles 27 and 28, a residual velocity component exists in the fluid discharge that is substantially oriented in a tangential direction opposite to the rotor assembly rotation. Illustrated in FIG. 2, this residual velocity causes the liquid in base 21 of the centrifuge to swirl around in a cyclonic fashion. Energy from this residual velocity can be harnessed to assist fluid drainage from base 21 by attaching upstream-directed baffle 98 that scoops the swirling flow off of base sidewall 96 and re-directs the fluid in a radially outward direction into radial outlet drain 97. Baffle 98 is positioned over at least a portion of radial outlet drain 97 and projects in an upstream direction relative to the swirling flow in base 21. Baffle 98 preferably has a first end 98*a* attached to bottom surface 94 of base 21 and a second end 98*b* attached to sidewall 96 above radial outlet drain 97. In a preferred embodiment, baffle 98 further includes, as best seen in FIG. 2, a first side 98*c* projecting into the swirling flow of fluid and a second side 98*d* attached to sidewall 96 at a radial location downstream from radial outlet drain 97. As shown in FIG. 2, baffle 98 is oriented for the clockwise rotation of rotor assembly 24 produced by exit flow jets 99 from nozzles 27 and 28. The use of baffle 98 in base 21 of centrifuge 20 is similar in concept to the use of upstream-oriented air-ram inlets on highway trucks to increase the pressure at the air inlet location, thereby improving air flow to the truck engine.

Figure 3:
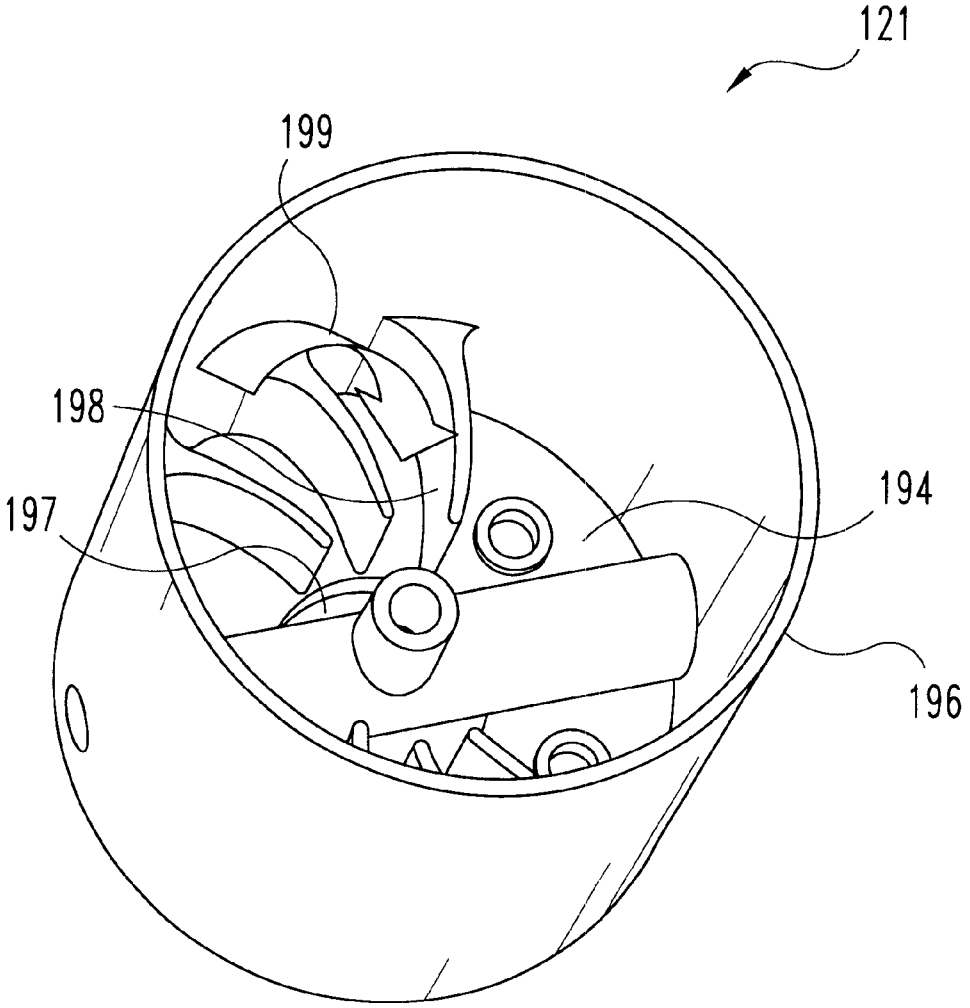
FIG. 3 is a perspective view of the base of a cone-stack centrifuge according to an alternative embodiment of the present invention.

In some cone-stack centrifuges, such as that illustrated in FIG. 3, the fluid outlet in base 121 is preferably central bottom drain 197. In order to assist the drainage of fluid from base 121, vanes 198 are connected to bottom surface 194 of base 121. Vanes 198 are oriented in a direction such that they re-direct the swirling flow near sidewall 196 radially inward toward central bottom drain 197. Additionally or alternatively, vanes 198 may be connected to sidewall 196 of base 121. In a preferred embodiment, vanes 198 are spiral-shaped and cast or molded into base 121. Further, vanes 198 preferably project vertically away from bottom surface 194.

Base 121 preferably includes between 1 and 10 vanes, with 2–6 vanes being more preferred. Provided that vanes 198 redirect the tangential velocity of the fluid at base sidewall 196 radially inward, vanes 198 can take on a variety of shapes, including but without limitation to, logarithmic spiral, planar, circular arc section, or hyperbolic spiral.

To achieve the desired radial redirection of the fluid flow, the included intercept angle between vane 198 and base sidewall 196 should be less than 90° which corresponds to a straight radial vane. Useful intercept angles range between 10°–80° and preferably range between 0°–45° in order to minimize fluid shock, and the concomitant loss in energy upon impact with the vane at the vane-sidewall interface. A 0° intercept angle can be achieved by employing a generous fillet radius between the vane and sidewall 196 at the point of intersection. Of course, the direction of the spiral, and the associated included intercept angle, must be oriented with respect to the direction of exit flow jets 99. FIG. 3 illustrates the proper orientation of vanes 198 for the counterclockwise rotation of a rotor assembly that creates a swirling flow in the direction of arrow 199.

From the above description, a person of skill in the art will readily appreciate that bases 21 and 121 can be incorporated into any number of designs of self-driven centrifuges. The present invention is therefore, not limited to the design of rotor assembly 24 of cone stack centrifuge 20. In this regard, the rotor assembly could take on various designs provided that it is constructed and arranged to rotate about an axis and that it is adapted to receive a fluid and to discharge at least a portion of that fluid through a tangential flow nozzle, such as nozzles 27 and 28. This discharge of fluid causes the rotor assembly to rotate and simultaneously causes the swirling of fluid in the base. Thus, the incorporation of either base 21 or 121 with such a rotor assembly assists the drainage rate and reduces the pooling of fluid in the base. Alternative rotor assemblies include, for example but without limitation, a take-apart hero turbine without a cone stack, as well as centrifuges in which the vertical cone stack is replaced by a unitary, molded spiral vane module.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A cone-stack centrifuge for separating particulate material out of a circulating fluid, said centrifuge comprising:

a rotor assembly constructed and arranged to rotate about an axis, said rotor assembly including a cone-stack, a hollow rotor hub, a centrifuge bowl, and a bottom plate assembled to said centrifuge bowl and including at least one tangential flow nozzle for creating an exit flow jet, said exit flow jet causing said rotor assembly to rotate, said rotor hub extending through said centrifuge bowl and through said bottom plate;

a base defining a fluid inlet, a passageway connected to said fluid inlet, a fluid outlet, a base hub, a sidewall, and a bottom surface;

a shaft attached to said base hub and extending through said rotor hub, said shaft having a passageway therein for delivering said fluid from said base passageway to said cone-stack;

a bearing positioned between said rotor hub and said shaft for rotary motion of said rotor assembly about said shaft;

said base having means for re-directing a swirling flow of said fluid in said base in a radial direction into said fluid outlet; and wherein said fluid outlet is a radial outlet drain in said base sidewall and said means for re-directing said swirling flow is a baffle that urges said swirling flow in a radially outward direction.

2. The apparatus of claim 1, wherein said baffle projects in an upstream direction relative to said swirling flow.

3. The apparatus of claim 1, wherein a length of said baffle is attached to said base sidewall at a location downstream from said radial outlet drain.

4. The apparatus of claim 1, wherein a length of said baffle is attached to said base sidewall above said radial outlet drain.

5. The apparatus of claim 1, wherein an end of said baffle is attached to said base bottom surface.

6. A cone-stack contrifuge for separating particulate material out of a circulating fluid, said centrifuge comprising:

a rotor assembly constructed and arranged to rotate about an axis, said rotor assembly including a cone-stack, a hollow rotor hub, a centrifuge bowl, and a bottom plate assembled to said centrifuge bowl and including at least one tangential flow nozzle for creating an exit flow jet, said exit flow jet causing said rotor assembly to rotate, said rotor hub extending through said centrifuge bowl and through said bottom plate;

a base defining a fluid inlet, a passageway connected to said fluid inlet, a fluid outlet, a base hub, a sidewall, and a bottom surface;

a shaft attached to said base hub and extending through said rotor hub, said shaft having a passageway therein for delivering said fluid from said base passageway to said cone-stack;

a bearing positioned between said rotor hub and said shaft for rotary motion of said rotor assembly about said shaft;

said base having means for re-directing a swirling flow of said fluid in said base in a radial direction into said fluid outlet; and wherein said fluid outlet is a central bottom drain and said means for re-directing said swirling flow is at least one vane connected to said base bottom surface to urge said swirling flow in a radially inward direction, wherein said vane is spiral-shaped.

7. A base for a self-driven centrifuge having a rotor assembly constructed and arranged to rotate about an axis and adapted to receive a fluid and to discharge at least a part of the fluid through at least one tangential flow nozzle creating an exit flow jet, the exit flow jet causing rotation of the rotor assembly, said base comprising:

a sidewall;

a bottom surface;

a fluid outlet;

means for re-directing a swirling flow of at least a part of said fluid in said base in a radial direction into said fluid outlet; and wherein said fluid outlet is a radial outlet drain in said base sidewall and said means for re-directing said swirling flow is a baffle that urges said swirling flow in a radially outward direction.

8. A centrifuge, comprising:

a rotor assembly;

a flow nozzle defined in said rotor assembly to spin said rotor assembly by discharging fluid;

a centrifuge base, said centrifuge base including a bottom surface, a sidewall extending from said bottom surface to define an interior space, a fluid outlet defined in said base, and a baffle extending into said interior space, said baffle being constructed and arranged to re-direct the fluid discharged from said flow nozzle in a radial direction into said fluid outlet;

wherein said fluid outlet is defined in said sidewall;

wherein said baffle is constructed and arranged to deflect said fluid in a radially outward direction into said fluid outlet; and wherein said baffle includes a first end attached to said bottom surface, and a second end attached to said sidewall above said fluid outlet.

9. The centrifuge of claim 8, wherein said baffle further includes a first side projecting into a swirling flow path of said fluid, and a second side attached to said sidewall downstream from said fluid outlet.

10. The apparatus of claim 8, wherein said rotor assembly includes a cone-stack.

11. A centrifuge, comprising:

a rotor assembly;

a flow nozzle defined in said rotor assembly to spin said rotor assembly by discharging fluid;

a centrifuge base, said centrifuge base including a bottom surface, a sidewall extending from said bottom surface to define an interior space, a fluid outlet defined in said base, and a baffle extending into said interior space, said baffle being constructed and arranged to re-direct the fluid discharged from said flow nozzle in a radial direction into said fluid outlet;

wherein said fluid outlet is centrally defined in said bottom surface;

wherein said baffle includes a vane constructed and arranged to deflect said fluid in a radially inward direction into said fluid outlet; and wherein said vane in includes a spiral vane connected to said sidewall and said bottom surface.

12. The apparatus of claim 11, wherein an intercept angle formed between said vane and said sidewall is less than ninety degrees.

13. The apparatus of claim 11, wherein said rotor assembly includes a cone-stack.

* * * * *